United States Patent [19]

Barclay

[11] Patent Number: 4,507,178

[45] Date of Patent: Mar. 26, 1985

[54] ELECTRODEPOSITION OF CHROMIUM AND ITS ALLOYS

[75] Inventor: Donald J. Barclay, Winchester, England

[73] Assignee: International Business Machines Corporation, Armonk, N.Y.

[21] Appl. No.: 451,515

[22] Filed: Dec. 20, 1982

[30] Foreign Application Priority Data

Feb. 9, 1982 [GB] United Kingdom ..... 8203765

[51] Int. Cl.[3] ..... C25D 5/34

[52] U.S. Cl. ..... 204/29; 204/32.1; 204/51

[58] Field of Search ..... 204/29, 32 R, 33, 34, 204/41, 51

[56] References Cited

U.S. PATENT DOCUMENTS

| | | | |
|---|---|---|---|
| 1,922,853 | 8/1933 | Kissel | 204/1 |
| 3,098,804 | 7/1963 | Wittrock | 204/41 |
| 3,620,834 | 11/1971 | Duffy | 204/30 X |
| 3,658,661 | 4/1972 | Minklei | 204/30 |
| 3,682,786 | 8/1972 | Brown | 204/30 |
| 4,062,737 | 12/1977 | Barclay et al. | 204/43 R |
| 4,080,269 | 3/1978 | Scholz et al. | 204/56 R |
| 4,161,432 | 7/1979 | Barclay et al. | 204/51 |
| 4,239,604 | 12/1980 | Mahdjuri | 204/56 R |
| 4,256,548 | 3/1981 | Barclay et al. | 204/43 R |
| 4,278,512 | 7/1981 | Barclay et al. | 204/41 |

FOREIGN PATENT DOCUMENTS

| | | |
|---|---|---|
| 54-87643 | 7/1979 | Japan . |
| 55-11919 | 2/1980 | Japan . |
| 414186 | 8/1934 | United Kingdom . |
| 575309 | 2/1946 | United Kingdom . |
| 877385 | 9/1961 | United Kingdom . |
| 1269487 | 4/1972 | United Kingdom . |
| 1415394 | 11/1975 | United Kingdom . |
| 1465879 | 3/1977 | United Kingdom . |
| 1488381 | 10/1977 | United Kingdom . |
| 1552263 | 9/1979 | United Kingdom . |
| 1591051 | 6/1981 | United Kingdom . |
| 2071151 | 9/1981 | United Kingdom . |
| 1602404 | 11/1981 | United Kingdom . |
| 2093861 | 9/1982 | United Kingdom . |

*Primary Examiner*—G. L. Kaplan
*Assistant Examiner*—William T. Leader
*Attorney, Agent, or Firm*—Francis A. Sirr

[57] ABSTRACT

A trivalent chromium electroplating process where the part to be plated is first pretreated with a sulphur compound, in order to accelerate the reduction of chromium ions to chromium metal during a subsequent plating step.

26 Claims, No Drawings

ELECTRODEPOSITION OF CHROMIUM AND ITS ALLOYS

DESCRIPTION

1. Technical Field

This invention relates to the electrodeposition of chromium and its alloys from electrolytes containing trivalent chromium ions.

2. Background of the Invention

Chromium is commercially electroplated from electrolytes containing hexavalent chromium, but many attempts over the last fifty years have been made to develop a commercially acceptable process for electroplating chromium using electrolytes containing trivalent chromium salts. The incentive to use electrolytes containing trivalent chromium salts arises because hexavalent chromium presents serious health and environmental hazards—it is known to cause ulcers and is believed to cause cancer, and, in addition, has technical limitations including the cost of disposing of plating baths and rinse water.

The problems associated with electroplating chromium, from solutions containing trivalent chromium ions, are primarily concerned with reactions at both the anode and cathode. Other factors which are important for commercial processes are the material, equipment and operational costs.

In order to achieve a commercial process, the precipitation of chromium hydroxy species at the cathode surface must be minimized to the extent that there is a sufficient supply of dissolved, i.e., solution-free, chromium (III) complexes at the plating surface; and the reduction of chromium ions is promoted. U.S. Pat. No. 4,062,737 describes a trivalent chromium electroplating process in which the electrolyte comprises aquo chromium (III) thiocyanato complexes. The thiocyanate ligand stabilizes the chromium ions, inhibiting the formation of precipitated chromium (III) salts at the cathode surface during plating, and also promotes the reduction of chromium (III) ions. United Kingdom Patent Specification No. 1,591,051 describes an electrolyte comprising chromium thiocyanato complexes in which the source of chromium was a cheap and readily available chromium (III) salt such as chromium sulphate.

Improvements in performance, i.e. efficiency of plating rate, plating range and temperature range, were achieved by the addition of a complexant which provided one of the ligands for the chromium thiocyanato complex. These complexants, described in U.S. Pat. No. 4,161,432, comprised amino acids such as glycine and aspartic acid, formates, acetates or hypophosphites. The improvement in performance depended on the complexant ligand used. The complexant ligand was effective at the cathode surface to further inhibit the formation of precipitated chromium (III) species. In U.S. Pat. No. 4,161,432, it was noticed that the improvement in performance permitted a substantial reduction in the concentration of chromium ions in the electrolyte without ceasing to be a commercially viable process. In U.S. Pat. No. 4,278,512 practical electrolytes comprising chromium thiocyanato complexes were described which contained less than 30 mM chromium—the thiocyanate and complexant being reduced in proportion. The reduction in chromium concentration had two desirable effects, firstly the treatment of rinse wates was greatly simplified and, secondly, the color of the chromium deposit was much lighter.

Oxidation of chromium and other constituents of the electrolyte at the anode are known to progressively and rapidly inhibit plating. Additionally, some electrolytes result in anodic evolution of toxic gases. An electroplating bath having an anolyte separated from a catholyte by a perfluorinated cation exchange membrane, described in United Kindom Patent Specification No. 1,602,404, successfully overcomes these problems. Alternatively, an additive which undergoes oxidation at the anode in preference to chromium or other constituents, can be made to the electrolyte. A suitable additive is described in U.S. Pat. No. 4,256,548. The disadvantage of using an additive is the ongoing expense.

United Kingdom Patent Specification No. 1,552,263 describes an electrolyte for electroplating chromium containing trivalent chromium ions in concentration greater than 0.1 M and a 'weak' complexing agent for stabilizing the chromium ions. Thiocyanate is added to the electrolyte in substantially lower molar concentration than the chromium to increase the plating rate. It is surprisingly stated that the thiocyanate decomposes in the acid conditions of the electrolyte to yield dissolved sulphide. The single thiocyanate Example in Specification No. 1,552,263 required very high concentrations of chromium ions to produce an acceptable plating rate. This results in expensive rinse water treatment and loss of chromium.

United Kingdom Patent Specification No. 1,488,381 describes an electrolyte for electroplating chromium in which thiourea is suggested as a complexant, either singly or in combination with other compounds for stabilizing trivalent chromium ions, but no specific example or experimental results were given.

United Kingdom Patent Specification No. 2,093,861 describes a chromium electroplating solution containing trivalent chromium ions together with a dissolved organic compound in a proportion less than equimolar in relation to the trivalent chromium ions, which includes a —C═S group within the molecule. In a preferred form the compound is thiourea.

Japan published patent application No. 54-87643 describes an electrolyte for electroplating chromium in which oxalic acid, a hypophosphite or a formate is suggested as a complexant for stabilizing trivalent chromium ions. To improve stability and deposition rate a compound characterized as having a S—O bond in the molecule is added to the electrolyte. The compound is selected from the group consisting of thiosulphates, thionates, sulfoxylates and dithionites. However the concentration of chromium ions and complexant was very high, that is, greater than 0.4 M.

Japan published patent application No. 55-119192 describes an electrolyte for electroplating chromium which comprises trivalent chromium ions having a molar concentration greater than 0.01 M, one of aminoacetic acid, iminodiacetic acid, nitrilotriacetic acid and their salts, and one of dithionitic acid, sulphurous acid, bisulphurous acid, metabisulphurous acid and their salts. The electrolyte also contains alkali metal, alkali earth metal or ammonium salts for providing conductivity, and boric acid or borate for improving the plating and increasing the plating rate at high current densities.

U.S. Pat. No. 1,922,853 suggested the use of sulphites and bisulphites to avoid the anodic oxidation of chromium (III) ions. It was suggested than anodic oxidation could be prevented by using soluble chromium anodes and adding reducing agents such as sulphites or by using insoluble anodes cut off from the plating electrolyte by a diaphragm. However this approach was never adopted for a commercial chromium plating process.

Three related factors are responsible for many of the problems associated with attempts to plate chromium from trivalent electrolytes. These are, a negative plating potential which results in hydrogen evolution accompanying the plating reaction, slow electrode kinetics, and the propensity of chromium (III) to precipitate as hydroxy species in the high pH environment which exists at the electrode surface. The formulation of the plating electrolytes of the present invention is based on an understanding of how these factors could be contained.

Cr (III) ions can form a number of complexes with ligands, L, characterized by a series of reactions which may be summarized as:

$$\begin{array}{lll} Cr + L = CrL & K_1 \\ CrL + L = CrL_2 & K_2 \\ \ldots & \\ \ldots & \\ \text{etc.} & \end{array}$$

where charges are omitted for convenience and $K_1$, $K_2$, . . . etc. are the stability constants and are calculated from:

$$\begin{array}{l} K_1 = [CrL]/[Cr][L] \\ K_2 = [CrL_2]/[CrL][L] \\ \ldots \\ \ldots \\ \text{etc.} \end{array}$$

where the square brackets represent concentrations. Numerical values may be obtained from (1) "Stability Constants of Metal-Ion Complexes", Special Publication No. 17, The Chemical Society, London 1964—L. G. Sillen and A. E. Martell; (2) "Stability Constants of Metal-Ion Complexes", Supplement No. 1, Special Publication No. 25, The Chemical Society, London 1971—L. G. Sillen and A. E. Martell; (3) "Critical Stability Constants", Vol. 1 and 2, Plenum Press, New York 1975—R. M. Smith and A. E. Martell.

During the plating process, the surface pH can rise to a value determined by the current density and the acidity constant, pKa, and the concentration of the buffer agent (e.g. boric acid). This pH will be significantly higher than the pH in the bulk of the electrolyte, and under these conditions chromium-hydroxy species may precipitate. The value of $K_1$, $K_2$, . . . etc., and the total concentrations of chromium (III) and the complexant ligand, determine the extent to which precipitation occurs; the higher the values of $K_1$, $K_2$, . . . etc. the less precipitation will occur at a given surface pH. As plating will occur from solution-free (i.e. non-precipitated) chromium species, higher plating efficiencies may be expected from ligands with high K values.

However, a second consideration is related to the electrode potential adopted during the plating process. If the K values are too high, plating will be inhibited because of the thermodynamic stability of the chromium complexes. Thus, selection of the optimum range for the stability constants, and of the concentrations of chromium and the ligand, is a compromise between these two opposing effects: a weak complexant results in precipitation at the interface, giving low efficiency (or even blocking of plating by hydroxy species), whereas too strong a complexant inhibits plating for reasons of excessive stability.

A third consideration is concerned with the electrochemical kinetics of the hydrogen evolution reaction (H.E.R.), and of chromium reduction. Plating will be favored by fast kinetics for the latter reaction and slow kinetics for the H.E.R. Thus additives which enhance the chromium reduction process, or retard the H.E.R., will be beneficial with respect to efficient plating rates. It has been found that many sulphur containing species, such as thiocyanate; or species having S—S or S—O bonds; or species haing a —C═S group or a —C—S— group within the molecule, accelerate the reduction of chromium (III) to chromium metal.

Copending U.S. patent application Ser. No. 437,993 filed Nov. 1, 1982 describes a chromium electroplating electrolyte containing a source of trivalent chromium ions, a complexant, a buffer agent and thiocyanate ions for promoting chromium deposition, the thiocyanate ions having a molar concentration lower than that of chromium. The complexant is preferably selected so that the stability constant, $K_1$, of the chromium complex, as defined therein, is in the range $10^8 < K_1 < 10^{12}$ $M^{-1}$. By way of example, complexant ligands having $K_1$ values within the range $10^8 < K_1 < 10^{12}$ $M^{-1}$ include aspartic acid, iminodiacetic acid, nitrilotriacetic acid and 5-sulphosalicylic acid.

Copending U.S. patent application Ser. No. 437,989 filed Nov. 1, 1982 describes a chromium electroplating electrolyte containing a source of trivalent chromium ions, a complexant, a buffer agent and an organic compound having a —C═S group or a —C—S— group within the molecule for promoting chromium deposition, the complexant being selected so that the stability constant, $K_1$, of the chromium complex, as defined therein, is in the range $10^8 < K_1 < 10^{12}$ $M^{-1}$. By way of example, complexant ligands $K_1$ values within the range $10^8 < K_1 < 10^{12}$ $M^{-1}$ include aspartic acid, iminodiacetic acid, nitrilotriacetic acid and 5-sulphosalicylic acid. The organic compound having —C═S group can be selected from thiourea, N-monoallyl thiourea, M-mono-p-tolyl thiourea, thioacetamide, tetramethyl thiuram monosulphide, tetraethyl thiuram disulphide and diethyldithiocarbonate. The organic compound having a —C—S— group can be selected from mercaptoacetic acid and mercaptopropionic acid.

Copending U.S. patent application Ser. No. 437,992 filed Nov. 1, 1982 describes a chromium electroplating electrolyte containing a source of trivalent chromium ions, a complexant, a buffer agent and a sulphur species having S—O or S—S bonds for promoting chromium deposition, the complexant being selected so that the stability constant, $K_1$, of the chromium complex, as defined therein, is in the range $10^6 < K_1 < 10^{12}$ $M^{-1}$, and the sulphur species being selected from thiosulphates, thionates, polythionates and sulfoxylates. By way of example, complexant ligands having $K_1$ values within the range $10^6 < K_1 < 10^{12}$ $M^{-1}$ include aspartic acid, iminodiacetic acid, nitrilotriacetic acid, 5-sulphosalicylic acid and citric acid. The sulphur species are provided by dissolving one or more of the following in the electrolyte: sodium thiosulphate, potassium thiosulphate, barium thiosulphate, ammonium thiosulphate, calcium thiosulphate, potassium polythionate, sodium polythionate, and sodium sulfoxylate.

Copending U.S. patent application Ser. No. 438,075 filed Nov. 1, 1982 describes a chromium electroplating electrolyte containing a source of trivalent chromium ions, a complexant, a buffer agent and a sulphur species selected from sulphites and dithionites for promoting chromium deposition, the complexant being selected so that the stability constant, $K_1$, of the chromium complex, as defined therein, is in the range $10^6 < K_1 < 10^{12}$ $M^{-1}$, and the chromium ions having a molar concentration lower than 0.01 M. By way of example, complexant ligands having $K_1$ values within the range $10^6 < K_1 < 10^{12}$ $M^{-1}$ include aspartic acid, iminodiacetic acid, nitrilotriacetic acid, 5-sulphosalicylic acid and citric acid. Sulphites can include bisulphites and metabisulphites.

In the preceding four copending patent applications, only very low concentrations of the sulphur species are needed to promote reduction of the trivalent chromium ions. Also, since the plating efficiency of the electrolyte is relatively high, a commercial trivalent chromium electrolyte can have as low as 5 mM chromium. This removes the need for expensive rinse water treatment since the chromium content of the 'drag-out' from the plating electrolyte is extremely low. In general, the concentration of the constituents in the electrolyte is as follows:

| | |
|---|---|
| Chromium (III) ions | $10^{-3}$ to 1 M |
| Sulphur species | $10^{-5}$ to $10^{-2}$ M |

A practical chromium/complexant ligand ratio is approximately 1:1.

In the above mentioned pending patent applications, it was found that for a minimum concentration necessary for acceptable plating ranges, it is unnecessary to increase the amount of the sulphur species in proportion to the concentration of chromium in the electrolyte. Excess of the sulphur species may not be harmful to the plating process, but can result in an increased amount of sulphur being codeposited with the chromium metal. This has two effects, firstly to produce a progressively darker deposit and, secondly, to produce a more ductile deposit. The preferred source of trivalent chromium is chromium sulphate which can be in the form of a commercially available mixture of chromium and sodium sulphates known as tanning liquor or chrometan. Other trivalent chromium salts, which are more expensive than the sulphate, can be used, and include chromium chloride, carbonate and perchlorate. The preferred buffer agent, used to maintain the pH of the bulk electrolyte, comprises boric acid in high concentrations, i.e., near saturation. Typical pH range for the electrolyte is in the range 2.5 to 4.5. The conductivity of the electrolyte should be as high as possible to minimize both voltage and power consumption. Voltage is often critical in practical plating environments, since rectifiers are often limited to a low voltage, e.g. 8 volts. In an electrolyte in which chromium sulphate is the source of the trivalent chromium ions, a mixture of sodium and potassium sulphate is the optimum. Such a mixture is described in United Kingdom Patent Specification No. 2,071,151. A wetting agent is desirable and a suitable wetting agent is FC98, a product of the 3M Corporation. However other wetting agents such as sulphosuccinates or alcohol sulphates may be used.

In the electroplating process used in the above mentioned pending patent applications, it is preferred to use a perfluorinated cation exchange membrane to separate the anode from the plating electrolyte, as described in United Kingdom Patent Specification No. 1,602,404. A suitable perfluorinated cation exchange membrane is Nafion (Trademark) a product of the E. I. du Pont de Nemours & Co. It is particularly advantageous to employ an anolyte which has sulphate ions when the catholyte uses chromium sulphate as the source of chromium, since inexpensive lead or lead alloy anodes can be used. In a sulphate anolyte, a thin conducting layer of lead oxide is formed on the anode. Chloride salts in the catholyte should be avoided since the chloride anions are small enough to pass through the membrane in sufficient amount to cause both the evolution of chlorine at the anode and the formation of a highly resistive film of lead chloride on lead or lead alloy anodes. Cation exchange membranes have the additional advantage in sulphate electrolytes that the pH of the catholyte can be stabilized, by adjusting the pH of the anolyte to allow hydrogen ion transport through the membrane, to compensate for the increase in pH of the catholyte by hydrogen evolution at the cathode. Using the combination of a membrane, and sulphate based anolyte and catholyte, a plating bath has been operated for over 40 Amphours/liter without pH adjustment.

THE INVENTION

In the prior art described above, the inclusion of low concentrations of many different sulphur species in a chromium plating electrolyte was found to accelerate the reduction of chromium ions to chromium metal. It has now been discovered that the sulphur species need not be included in the electrolyte, if the surface to be plated has been pretreated to form a deposit of sulphur compound thereon.

Accordingly, the present invention provides a process for electroplating chromium comprising pretreating the surface of a part to be plated with chromium by forming a deposit of sulphur compound thereon, which compound accelerates the reduction of chromium ions to chromium metal.

Preferably, the sulphur compound is deposited cathodically, that is electrochemically from a solution containing a sulphur species. The parts are then rinsed in water, and electroplated with chromium in an electrolyte containing a source of trivalent chromium, a complexant and a buffer agent. The chromium electrolyte need not contain a sulphur species to achieve satisfactory chromium deposits. Alternatively the sulphur compound can be chemically deposited on the surface of the part to be plated by evaporating sulphur on to the surface or by immersing the part to be plated in a solution of a sulphide ions whereby a sulphur compound is deposited without the necessity of cathodic deposition.

The sulphur species used in the electrochemical pretreatment process can be selected from thiocyanate, a species having S—S or S—O bonds; or a species having a —C═S group or a —C—S— group within the molecule.

When deposition is achieved electrochemically or chemically by immersion in an aqueous solution of a sulphur species, the solution need not be as low a concentration as that described in the four copending United States patent applications mentioned above, where the species is included in the plating electrolyte. The succeeding chromium plating step can use one of the electrolytes described in the four copending applications, except that the sulphur species need not be present in the plating electrolyte.

Preferably, the complexant used in the plating electrolyte is selected so that the stability constant, $K_1$, of the chromium complex, as defined herein, is in the range $10^6 < K_1 < 10^{12}$ $M^{-1}$. Typical complexants are citric acid, aspartic acid, iminodiacetic acid, nitrilotriacetic acid or 5-sulphosalicylic acid.

The present invention offers significant commercial advantages in both the control of the plating process and in the selection of constituents.

The invention will now be described with reference to the following Examples. The preferred process consists of three steps: a pretreatment step; a rinse step; and a chromium plating step.

EXAMPLE A

The pretreatment step was performed in a bath containing a 0.5 M aqueous solution of sodium thiosulphate. An area of the part to be pretreated was cathodized in the thiosulphate solution for approximately 30 seconds. The concentration of the thiosulphate and the cathodizing time were not found to be critical.

The pretreated parts were then rinsed in water.

The chromium plating step was performed in a bath consisting of an anolyte separated from a catholyte by a Nafion cation exchange membrane. The anolyte comprised an aqueous solution of sulphuric acid in 2% by volume concentration (pH 1.6). The anode was a flat bar of a lead alloy of the type conventionally used in hexavalent chromium plating processes.

The catholyte was prepared by making up a base electrolyte and adding appropriate amounts of chromium (III) and complexant.

The base electrolyte consisted of the following constituents dissolved in 1 liter of water:

| | |
|---|---|
| Potassium sulphate | 1 M |
| Sodium sulphate | 0.5 M |
| Boric acid | 1 M |
| Wetting agent FC98 | 0.1 gram |

The following constituents were dissolved in the base electrolyte:

| | |
|---|---|
| Chromium (III) | 10 mM (from chrometan) |
| DL Aspartic acid | 10 mM |
| at pH | 3.5 |

Although equilibration will occur quickly in normal use, initially the electrolyte is preferably equilibrated until there are no spectroscopic changes which can be detected. The bath was found to operate over a temperature range of 25° to 60° C. The pretreated area plated preferentially with a good bright deposit of chromium compared with the untreated area.

Alternatively the following constituents were dissolved in the base electrolyte:

| | |
|---|---|
| Chromium (III) | 100 mM (from chrometan) |
| DL Aspartic acid | 100 mM |
| Sodium thiosulphate | 1 mM |
| at pH | 3.5 |

The electrolyte was preferably equilibrated until there are no spectroscopic changes. The bath was found to operate over a temperature range of 25° to 60° C. Good bright deposits were obtained.

EXAMPLE B

The process is identical to that performed in Example A except that the pretreatment step comprises vapour deposition of a deposit of sulphur species on the part to be plated. Vapour deposition was achieved by suspending the part to be pretreated over a heated dish of sulphur, the neutral sulphur vapour condensing on to the area to be pretreated. The pretreated area plated preferentially with a good bright deposit of chromium compared with the untreated area.

EXAMPLE C

The process is identical to that performed in Example A except that the pretreatment step comprises immersing an area of the part to be plated in a solution of 0.1 M sodium sulphide for 30 seconds at room temperature. A deposit of a sulphur compound was chemically deposited on the pretreated area. The pretreated area plated preferentially with a good bright deposit of chromium compared with the untreated area.

While the invention has been particularly shown and described with reference to preferred embodiments thereof, it will be understood by those skilled in the art that various changes in form and details may be made therein without departing from the spirit and scope of the invention.

What is claimed is:

1. A process for electroplating chromium, comprising the step of:

pretreating the surface of a part to be plated with chromium, by forming a deposit of a sulphur compound thereon, which sulphur compound subsequently accelerates the reduction of chromium ions to chromium metal; and the subsequent step of electroplating chromium on said pretreated surface from an electrolyte containing trivalent chromium ions.

2. A process as claimed in claim 1, in which the deposit is formed cathodically in a solution containing a sulphur species, or by chemical deposition by immersion in a solution of a sulphur species or by vapour deposition.

3. A process as claimed in claim 1 wherein the subsequent step of electroplating chromium on said pretreated surface includes electroplating from an electrolyte containing a source of trivalent chromium ions, a complexant and a buffer agent.

4. A process as claimed in claim 2 wherein the subsequent step of electroplating chromium on said pretreated surface includes electroplating from an electrolyte containing a source of trivalent chromium ions, a complexant and a buffer agent.

5. A process as claimed in claim 1 wherein the subsequent step of electroplating chromium on said pretreated surface includes electroplating from an electrolyte containing a source of trivalent chromium ions, a complexant and a buffer agent, in which the electrolyte contains a sulphur species which accelerates the reduction of chromium ions to chromium metal.

6. A process as claimed in claim 2 wherein the subsequent step of electroplating chromium on said pretreated surface includes electroplating from an electrolyte containing a source of trivalent chromium ions, a complexant and a buffer agent, in which the electrolyte contains a sulphur species which accelerates the reduction of chromium ions to chromium metal.

7. A process as claimed in claim 1 wherein the subsequent step of electroplating chromium on said pretreated surface includes electroplating from an electrolyte containing a source of trivalent chromium ions, a complexant and a buffer agent, in which the complexant is selected so that the stability constant, $K_1$, of the chromium complex is in the range $10^6 < K_1 < 10^{12}\ M^{-1}$.

8. A process as claimed in claim 2 wherein the subsequent step of electroplating chromium on said pretreated surface includes electroplating from an electrolyte containing a source of trivalent chromium ions, a complexant and a buffer agent, in which the complexant is selected so that the stability constant, $K_1$, of the chromium complex is in the range $10^6 < K_1 < 10^{12}\ M^{-1}$.

9. A process as claimed in claim 1 wherein the subsequent step of electroplating chromium on said pretreated surface includes electroplating from an electrolyte containing a source of trivalent chromium ions, a complexant and a buffer agent, in which the complexant is selected from aspartic acid, iminodiacetic acid, nitrilotriacetic acid, 5-sulphosalicylic acid or citric acid.

10. A process as claimed in claim 2 wherein the subsequent step of electroplating chromium on said pretreated surface includes electroplating from an electrolyte containing a source of trivalent chromium ions, a complexant and a buffer agent, in which the complexant is selected from aspartic acid, iminodiacetic acid, nitrilotriacetic acid, 5-sulphosalicylic acid or citric acid.

11. A process for electroplating chromium comprising:

pretreating the part to be plated by subjecting it to a solution of a sulphur compound, to thereby form a deposit on the part which will subsequently accelerate the reduction of chromium ions to chromium metal; and subsequently electroplating chromium on said part from an electrolyte which contains a source of trivalent chromium ions, a complexant and a buffer agent.

12. The process as claimed in claim 11 wherein said electrolyte includes a sulphur species which accelerates the reduction of chromium ions to chromium metal.

13. The process as claimed in claim 12 wherein the complexant is selected to provide a stability constant, $K_1$, of the chromium complex in the range $10^6 < K_1 < 10^{12} M^{-1}$.

14. The process as claimed in claim 13 in which the complexant is selected from aspartic acid, iminodiacetic acid, nitrilotriacetic acid, 5-sulphosalicylic acid or citric acid.

15. The process as claimed in claim 14 in which the buffer is boric acid.

16. The process as claimed in claim 14 in which the sulphur species is selected from thiocyanate, or species having S—O or S—S bonds; or a species having a —C═S or —C—S— group within the molecule; or sulphide anions or neutral sulphur vapour.

17. The process as claimed in claim 16, in which the species having S—O and S—S bonds is selected from thiosulphates, thionates, dithionites, polythionates, sulfoxylates and sulphites, in which the species having —C═S bonds is selected from thiourea, N-monoallyl thiourea, N-mono-p-tolyl thiourea, thioacetamide, tetramethyl thiuram monosulphide, tetraethyl thiuram disulphide and diethyldithiocarbonate, and in which the species having —C—S— bonds is selected from mercaptoacetic and/or mercaptopropionic acid.

18. The process as claimed in claim 17 having an anode immersed in an anolyte which is separated from the electrolyte by a perfluorinated cation exchange membrane.

19. The process as claimed in claim 18, in which the anolyte comprises sulphate ions.

20. The process as claimed in claim 19, in which the anode is of a lead or lead alloy.

21. A process for electroplating chromium, comprising the ordered steps of:

pretreating the surface of a part to be plated with chromium by forming a deposit of a sulphur compound thereon, which sulphur compound subsequently accelerates the reduction of chromium ions to chromium metal, and then electroplating chromium on said pretreated surface from an electrolyte containing a source of trivalent chromium ions, a complexant and a boric acid buffer.

22. A process as defined in claim 21 in which the source of chromium ions is chromium sulphate, and in which the electrolyte includes conductivity ions selected from sulphate salts.

23. A process as defined in claim 22 in which the sulphate salts are a mixture of sodium and potassium sulphate.

24. A process as claimed in claim 23 in which the electrolyte contains a sulphur species which accelerates the reduction of chromium ions to chromium metal.

25. A process as claimed in claim 24 in which the sulphur species is selected from thiocyanate, or a species having S—O or S—S bonds; or a species having a —C═S or —C—S— group within the molecule.

26. A process as claimed in claim 25 in which a lead or lead alloy anode is placed in an anolyte comprising sulphate ions, and in which the anolyte is separated from the electrolyte by a perfluorinated cation exchange membrane.

* * * * *